United States Patent [19]

Loos et al.

[11] Patent Number: 5,012,739

[45] Date of Patent: May 7, 1991

[54] WASHING DEVICE

[75] Inventors: Gerhard Loos, Horrenberg; Nikolaus Spiegel, Walldorf, both of Fed. Rep. of Germany

[73] Assignee: Heidelberger Druckmaschinen AG, Heidelberg, Fed. Rep. of Germany

[21] Appl. No.: 496,530

[22] Filed: Mar. 20, 1990

[30] Foreign Application Priority Data

Mar. 20, 1989 [DE] Fed. Rep. of Germany ..... 3909114

[51] Int. Cl.[5] ..... B41F 35/00; B41L 41/00

[52] U.S. Cl. ..... 101/425; 101/423

[58] Field of Search ..... 101/423, 424, 425, 424.1

[56] References Cited

U.S. PATENT DOCUMENTS

| | | | |
|---|---|---|---|
| 4,344,361 | 8/1982 | MacPhee et al. | 101/425 |
| 4,651,644 | 3/1987 | Kaempfe et al. | 101/425 |
| 4,757,763 | 7/1988 | MacPhee et al. | 101/425 |
| 4,876,064 | 8/1989 | Hara et al. | 101/425 |
| 4,920,880 | 5/1990 | Hara et al. | 101/425 |

FOREIGN PATENT DOCUMENTS

| | | | |
|---|---|---|---|
| 476011 | 8/1951 | Canada | 101/425 |
| 804801 | 8/1979 | Fed. Rep. of Germany | 101/425 |

*Primary Examiner*—Edgar S. Burr
*Assistant Examiner*—Joseph R. Keating
*Attorney, Agent, or Firm*—Herbert L. Lerner; Laurence A. Greenberg

[57] ABSTRACT

Washing device of a printing machine for cleaning the outer cylindrical surface of a roller or a cylinder, comprising a supply roll and a take-up roll for a cleaning cloth dampenable with washing medium, means for withdrawing the cleaning cloth from the supply roll by winding it on the take-up roll via an actuable pressure applicator so that, during a washing operation, the pressure applicator, presses the cleaning cloth against a roller or cylinder, the pressure applicator having an elastic membrane member which is sealed with respect to a spacer, and means for forming a compressed-air cushion between the membrane member and the spacer, a holding member for receiving the spacer therein in a manner like that of a sliding block, the membrane member having marginal regions thereof engaging behind guiding projections of the holding member, the spacer being biased towards the guiding projections for sealingly clamping the marginal regions of the membrane therebetween.

6 Claims, 6 Drawing Sheets

WASHING DEVICE

The invention relates to a washing device of a printing machine for cleaning the surface of a roller or a cylinder, e.g., for cleaning the blanket of a blanket cylinder.

A washing device of this general type is usually equipped with a supply roll and a take-up roll for a cleaning cloth, the cleaning cloth being dampened with a washing liquid. While the cleaning cloth is being wound on the take-up roll, the cleaning cloth is transported over a pressure applicator which is selectively actuable to bring the cleaning cloth into contact with the roller or cylinder, e.g., the blanket of the blanket cylinder which is to be cleaned. The pressure applicator, as such, includes an elastic membrane member held or gripped by a spacer. The pressure applicator is actuable by producing a compressed-air cushion between the membrane member and the spacer. The spacer, in the actuated condition thereof, is concerned with the remaining spacing of the marginal regions of the membrane member from the spacer and, only when it is eliminated, can the compressed-air cushion be produced between the membrane member and the spacer.

Such a washing device has become known heretofore, e.g., from the German Published Non-Prosecuted Application (DE-OS) 30 05 469 in which the spacer is U-shaped and, in a cross-sectional view, the membrane member covers the opening of the U-shaped spacer. With this conventional washing device, the marginal regions of the membrane member are sealingly mounted outside on the legs of the U-shaped spacer. In this conventional washing device, the sealing attachment of the membrane member has been found to be very costly. The sealing effect is achieved by fastening the marginal regions of the membrane member to the legs of the U-shaped spacer by means of a number of screws and through the intermediary of a strip or rail. Such a fastening has to be performed at the two elongated sides of the spacer.

Starting from the aforementioned state of the art, it is an object of the invention to provide an improved washing device having a pressure applicator which is relatively easy to manufacture and to use.

With the foregoing and other objects in view, there is provided, in accordance with the invention, a washing device of a printing machine for cleaning the outer cylindrical surface of a roller or a cylinder, comprising a supply roll and a take-up roll for a cleaning cloth dampenable with washing medium, means for withdrawing the cleaning cloth from the supply roll by winding it on the take-up roll via an actuable pressure applicator so that, during a washing operation, the pressure applicator, presses the cleaning cloth against a roller or cylinder, the pressure applicator having an elastic membrane member which is sealed with respect to a spacer, and means for forming a compressed-air cushion between the membrane member and the spacer, a holding member for receiving the spacer therein in a manner like that of a sliding block, the membrane member having marginal regions thereof engaging behind guiding projections of the holding member, the spacer being biased towards the guiding projections for sealingly clamping the marginal regions of the membrane therebetween.

According to the invention, the spacer is received like a sliding block in a holding member. The marginal regions of the membrane member, at least the marginal regions at the longer sides thereof, are sealingly clamped between the spacer and the guiding member. More precisely, the marginal regions are clamped between the guiding projections of the holding member and the assigned marginal regions of the spacer. As in the case of the heretofore known washing device, the spacer provides a closed pressure chamber, e.g., on the side of the membrane member which faces away from a cylinder or roller, such as a blanket cylinder, i.e., on the underside of the membrane member, the spacer forming the base of the pressure chamber, and serving, so to speak, as a member which grips or clamps the membrane member and which, in the actuated state, permits a bulging of the membrane member due to the fact that the marginal regions are being held. Moreover, with respect to the subject-matter of the invention, the spacer, however, serves directly for holding and clamping the marginal regions of the membrane member, as described hereinabove. The pressure applicator extends substantially over the entire length of the roller or cylinder to be cleaned so that the aforementioned marginal regions at the elongated or longer sides of the membrane member refer to those marginal regions extending substantially parallel to the axis of the roller or cylinder. With such a construction, the spacer as well as the membrane member, which may have such preformed marginal regions, may be advantageously constructed as slide-in members.

Together with the spacer, the membrane member may be inserted into the holding member and be clamped, in the inserted condition, between the spacer and the holding member. The membrane member is suitably provided with preformed projecting marginal regions which, when inserted into the holding member, may engage behind the guiding projections of the holding member. When it is being inserted into the holding member, the membrane member is held formlockingly or positively in the holding member, perpendicularly to the direction of insertion; this applies, as well, to the spacer.

In accordance with another feature of the invention, the washing device includes tightening screws braced against the holding member for biasing the spacer towards the guiding projections of the holding member. A closed flow circuit of bracing forces occurs between the holding member and spacer, through the intermediary of the membrane member, with the marginal regions at the longer sides of the membrane member and the holding member, on one hand, and of the spacer, on the other hand, cooperating formlockingly or positively. Basically, the membrane member requires only a little or no preforming with respect to the marginal regions. In the unactuated condition, i.e., when there is no compressed-air cushion between the membrane member and the spacer, as is described hereinafter in greater detail, the spacer determines the shape of the membrane member. In the actuated condition, the spacer is responsible for producing a bulge which brings the cleaning cloth into contact with a roller or cylinder, such as the blanket cylinder. According to a preferred construction of the invention, the membrane member may be adapted beforehand largely to the shape of the spacer by preforming, especially with respect to the aforementioned lengthwise projecting marginal regions which are clamped between the spacer and the holding member so as to produce a sealing effect.

In accordance with a further feature of the invention, the guiding projections extend in a given direction, and the spacer is biased by a tightening force of the tightening screws in a direction perpendicular to the given direction in which the guiding projections extend. Accordingly, the tightening screws act approximately on the center of the spacer, as viewed in cross section. Due to the required elasticity, the membrane member is made of a rubber-elastic material, whereas the spacer and the holding member may be formed, e.g., of drawn metal profile members or sections. The pressure applicator is actuated by pneumatically inflating the membrane member.

For this purpose, in accordance with an added feature of the invention, the spacer is provided with a compressed-air supply connection freely projecting through the holding member but rigidly connected to the spacer. When the screws are tightened for clamping the spacer to the holding member, the compressed-air supply connection, fixed in position in the holding member, is freely movable with respect to the holding member. The compressed-air supply connection terminates in a respective bore formed in the spacer. By producing a compressed-air cushion, the membrane member, in the actuated state, is lifted from the spacer, with formation of a bulge, as described hereinabove. The cleaning cloth, running over the membrane member at the outside thereof, is pressed into contact with the cylinder and roller, respectively, which is to be cleaned.

With respect to attaching the end or front walls of the membrane member, the invention provides for the membrane member to be firmly mounted on a respective end face of the spacer. For example, the respective front end wall of the membrane member can be connected with the respective front end of the spacer by means of fastening screws, in accordance with a concomitant feature of the invention. This results in an advantageous improvement in the basic concept of the invention, wherein the membrane member is sealingly clamped, on both sides, between the holding member and the spacer, the spacer being constructed so as to serve as a sliding block. The end wall of the membrane member, for assembly purposes, may be firmly connected with the spacer before being inserted into the holding member. Then, the spacer, together with the membrane member, can easily be inserted into the holding member. By tightening the tightening screws, the membrane member, as a whole, is sealingly held, respectively at and against the spacer. More precisely, a spring clamp for ensuring a uniform contact pressure over the entire width of a respective end wall is provided between the membrane member and the heads of the fastening screws for fastening the respective end wall of the membrane member to the spacer.

Other features which are considered as characteristic for the invention are set forth in the appended claims.

Although the invention is illustrated and described herein as embodied in a washing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
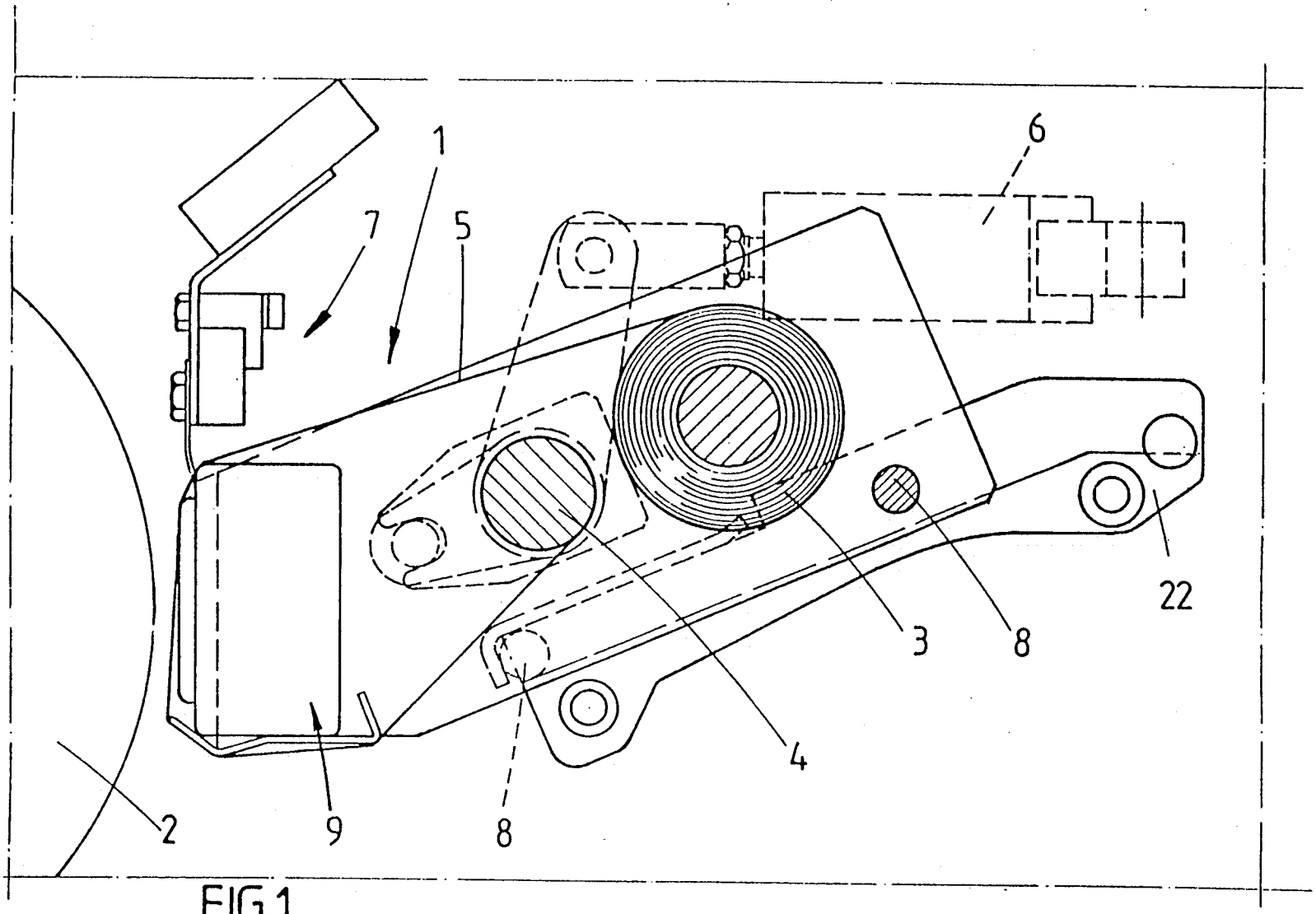
FIG. 1 is a side elevational view of the washing device according to the invention in an installed condition.
Figure 2:
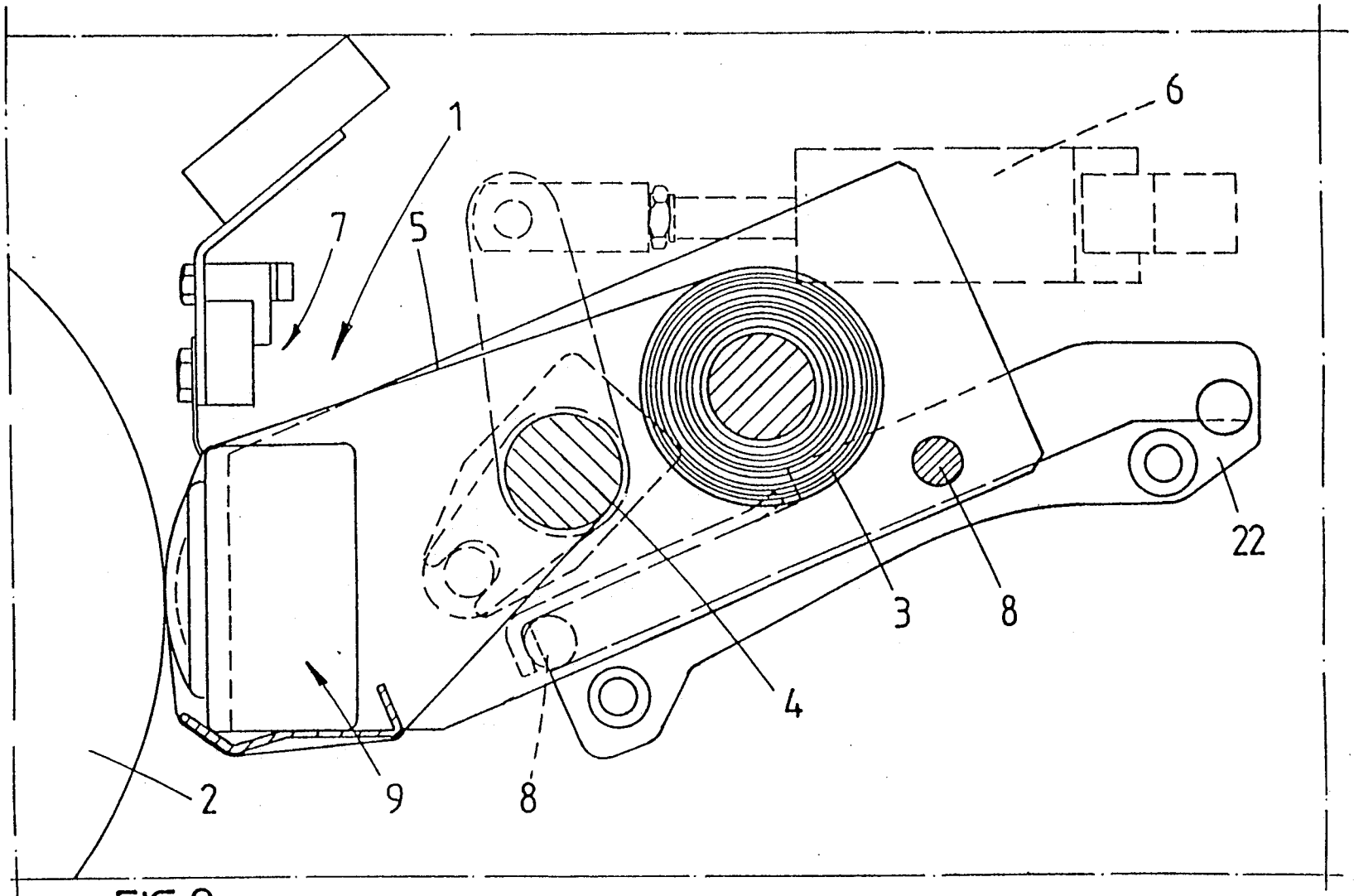
FIG. 2 is another view like that of FIG. 1 wherein a pressure applicator forming part of the washing device is in actuated condition.
Figure 3:
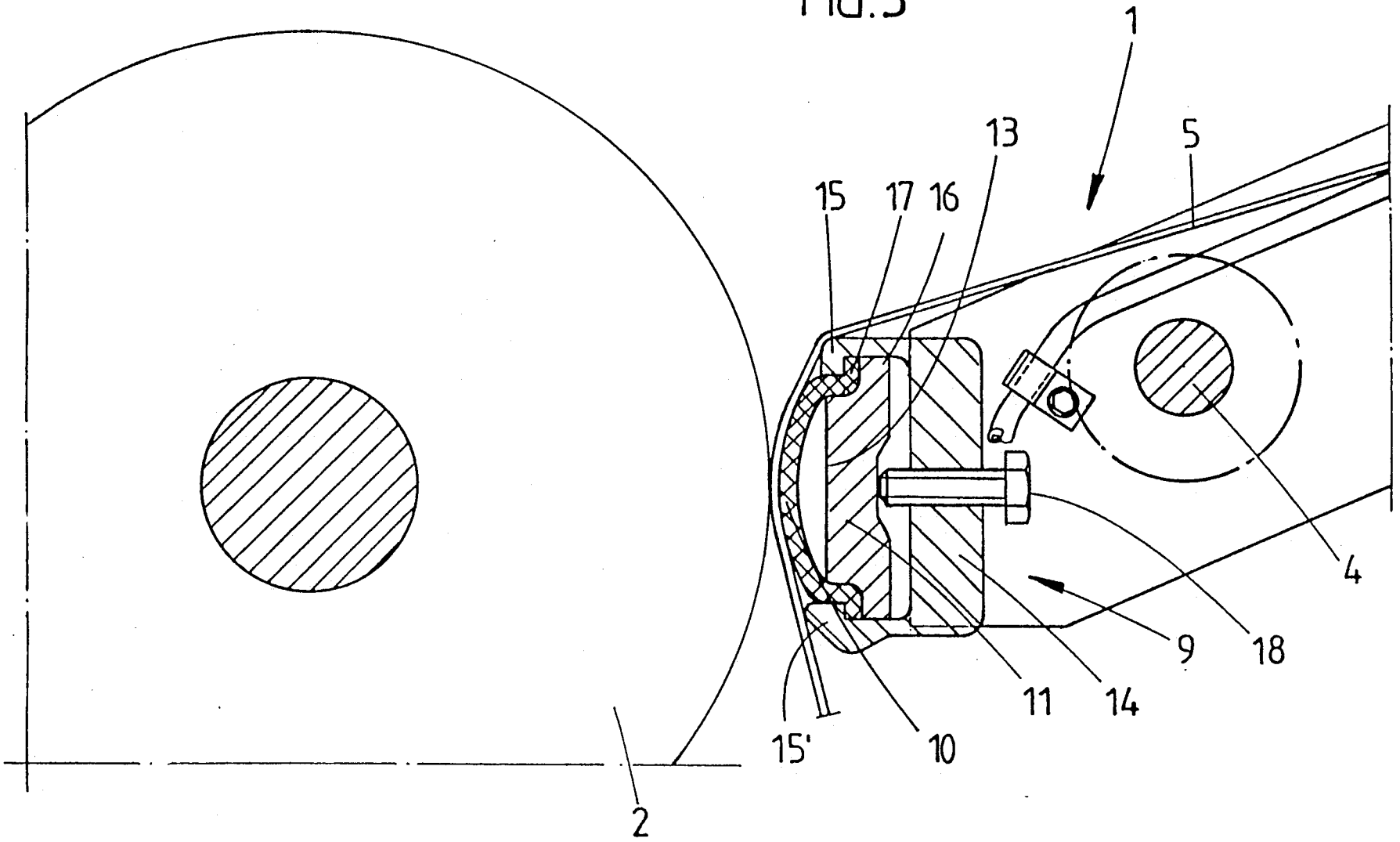
FIG. 3 is another view like that of FIG. 2 but showing the actuated pressure applicator in section.

Referring now to the drawing and first, particularly to FIGS. 1 to 3 thereof, there is shown therein a washing device 1 which, in its built-in or installed condition, is assigned to a blanket cylinder 2 of a printing machine. The washing device 1 is equipped with a supply roll 3 for a cleaning or washcloth which may be wound around a soiled washcloth take-up roll 4. The take-up roll 4 is actuable stepwise by means of a pneumatic device 6. A dispensing device 7 provides the washing liquid with which the cleaning cloth or washcloth 5 may be dampened.

Moreover, the illustrated washing device 1 is constructed as a slide-in device which is held by bolts 8 in a mounting support or holder 22 which is fixed to the machine.

Figure 4:
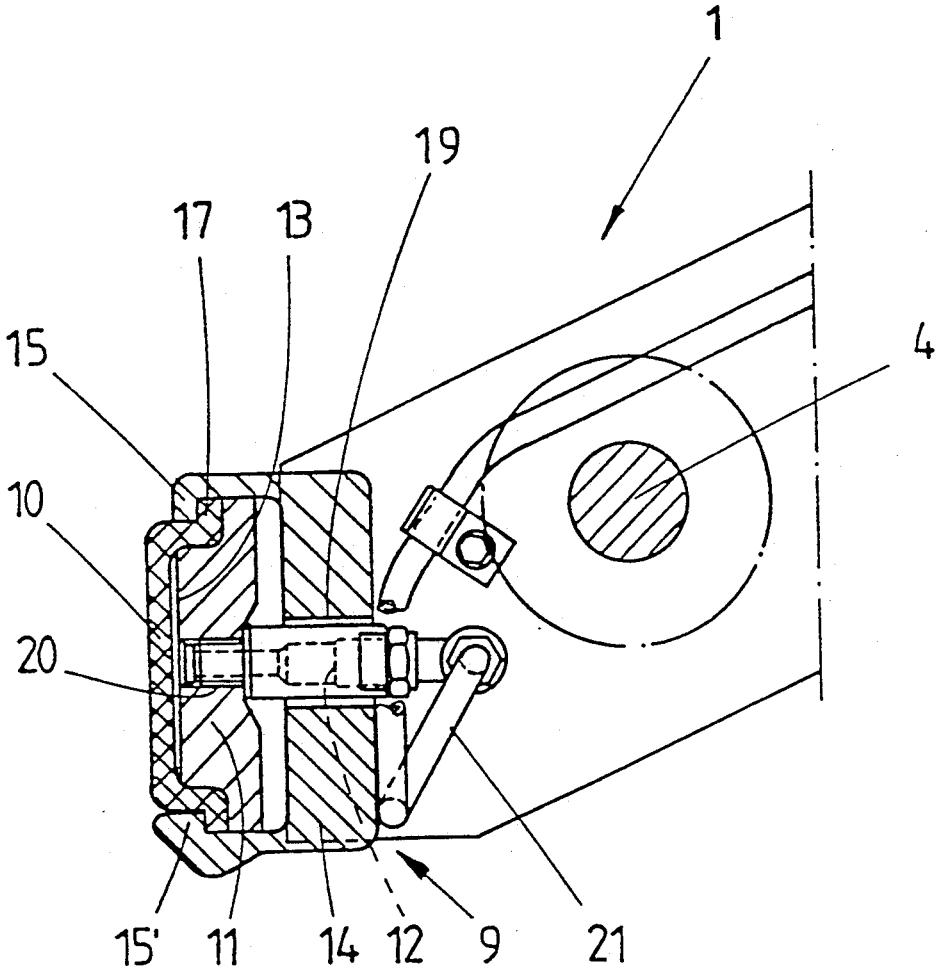
FIG. 4 is a fragmentary view of FIG. 3 showing the pressure applicator, in non-actuated condition, in vicinity of the compressed-air supply connection.

The cleaning cloth or washcloth 5, when being wound around the take-up roll 4, is drawn over or across a pressure applicator 9 which is illustrated in actuated condition thereof in FIGS. 2 and 3. In particular, the pressure applicator 9 includes a membrane member 10 which is sealingly held by a spacer 11. By means of a compressed-air supply connection 12 (see FIG. 4) it is possible to produce a compressed-air cushion between the membrane member 10 and a surface 13 of the spacer 11 facing towards the membrane member 10, for the purpose of pressing the cleaning cloth or washcloth 5, during a washing operation, against a cylinder or roller. In the illustrated embodiment of FIG. 4, the membrane member 10 is in contact with the substantially rectangular and planar outer surface 13 of the spacer 11. In the actuated condition of the pressure applicator 9, the membrane member 10 bulges, as shown in FIG. 3.

The spacer 11 and the membrane member 10 are received like sliding blocks in a mounting support or holding member 14. Marginal or border regions 16 and 17 of the spacer 11 and of the membrane member 10, respectively, engage behind guiding projections 15, 15' of the holding member 14. By means of tightening screws 18, which are braced against the holding member 14, the spacer 11 is biased against the guiding projections 15, 15' through the intermediary of the membrane member 10 and, more precisely, of the marginal regions 17 of the membrane member 10, respectively. The spacer 11 is subjected to an application of force by the tightening screws 18 perpendicularly to a direction in which the guiding projections 15, 15' extend. According to the sectional view of FIG. 3, it is apparent that the tightening screws 18 act approximately at the center of the spacer 11. The membrane member 10 is advantageously provided with preformed projecting marginal regions 17. For the purpose of assembly, the membrane member 10, exactly as the spacer 11, may simply be inserted into the holding member 14. The guiding projection 15' may be constructed so as to project farther towards the blanket cylinder 2 (note FIG. 2) for respectively guiding and deflecting the cleaning cloth or washcloth 5. The compressed-air supply connection 12 is illustrated in detail in FIG. 4. It freely projects through a bore 19 formed in the holding member 14 and is screwed into the spacer 11 by means of a thread 20. During assembly, i.e., during the tightening of the spacer 11 against the guiding projections 15, 15', the spacer 11 travels towards the guiding projections 15, 15'. The compressed-air supply connection 12 can follow this movement without any difficulty. Moreover, the compressed-air supply connection 12 is connected to a compressed-air supply line 21 which, for the purpose of supplying compressed air, extends out of the washing device to a non-illustrated source of compressed air.

Figure 5:
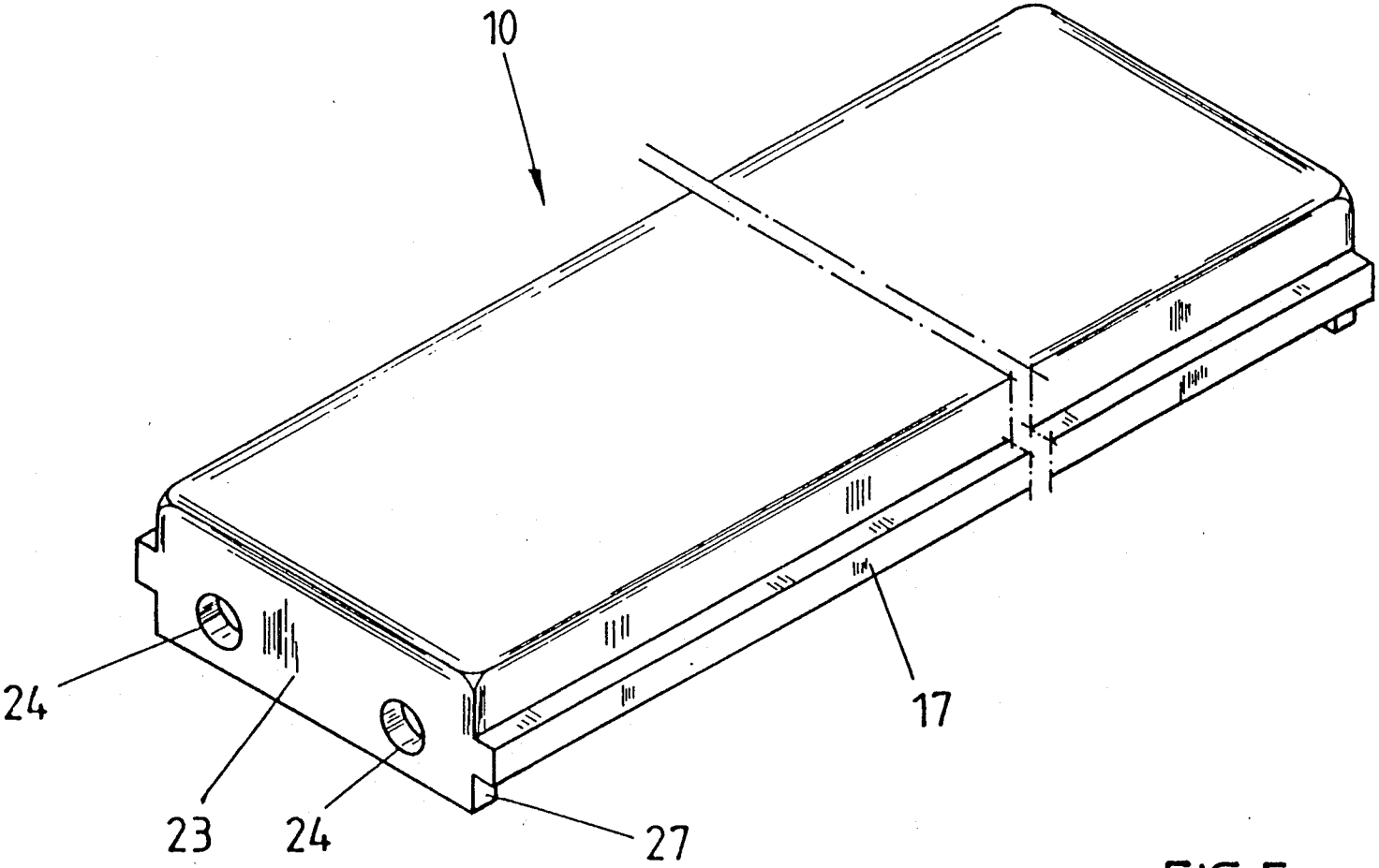
FIG. 5 is a perspective view of a membrane member forming part of the washing device according to the invention.

FIG. 5 is a perspective view of the membrane member 10, as a whole, which is formed of a rubber-elastic or elastomeric material. Outwardly projecting marginal regions 17 are located at the longer sides of the membrane member 10. A respective end wall 23 of the membrane member 10 has a wall portion 27 which projects downwardly beyond the elongated side walls, as viewed in the figure. Furthermore, in the embodiment illustrated in FIG. 5, the end wall 23 is formed with two fastening openings 24 to afford a screw connection, as shown hereinafter in greater detail in FIGS. 6 and 7. The end wall which is not visible in FIG. 5 has substantially like construction as the visible end wall 23.

Figure 6:
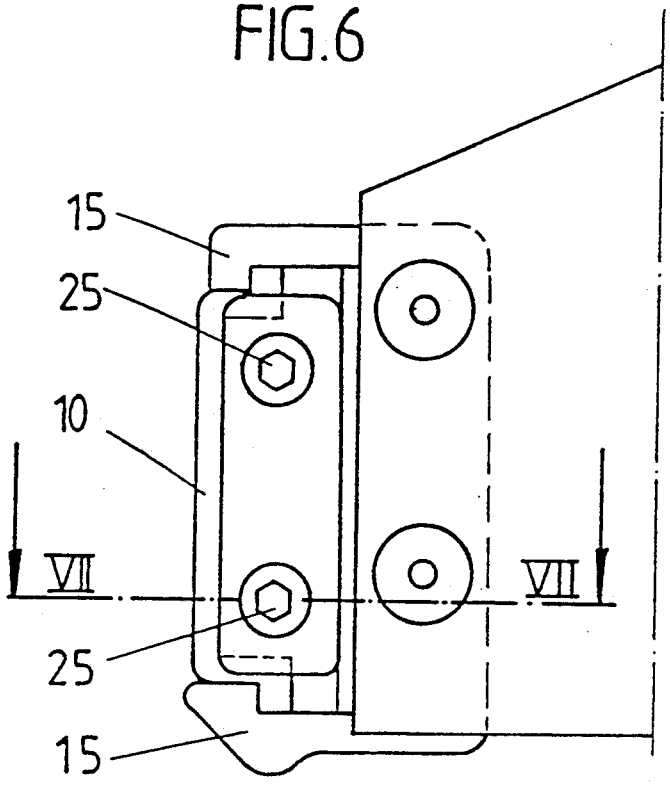
FIG. 6 is a diagrammatic view of details for fastening the membrane member at the end face of the pressure applicator.
Figure 7:
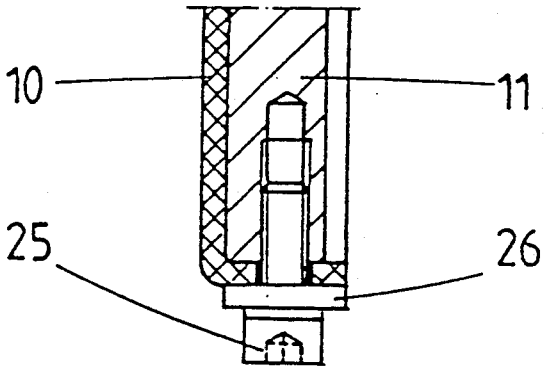
FIG. 7 is a fragmentary sectional view of FIG. 6 taken along the line VII—VII, showing only a spacer and the membrane member attached thereto in accordance with the invention.

From FIGS. 6 and 7, it is apparent that the attachment of the membrane member 10 at the end walls is effected by means of two screws 25 which are firmly anchored in the spacer 11. The screws 25 act upon the membrane member 10 via a spring clamp 26 stretching over the end wall 23. As a result thereof, the membrane member 10 is in sealing contact with the spacer 11 over the entire end wall.

For the purpose of assembly, for example, the membrane member 10 is initially firmly connected to the spacer 11 at the end wall 23, then the spacer 11, together with the membrane member 10 already attached thereto, is inserted into the holding or support member 14. Due to tightening the spacer 11 against the guiding projections 15, 15', as noted hereinabove, sealing between the membrane member 10, at the longer sides thereof, and the spacer 11 occurs.

The foregoing is a description corresponding in substance to German Application P 39 09 114.7, dated Mar. 20, 1989, the International priority of which is being claimed for the instant application, and which is hereby made part of this application. Any material discrepancies between the foregoing specification and the aforementioned corresponding German application are to be resolved in favor of the latter.

We claim:

1. Washing device of a printing machine for cleaning the outer cylindrical surface of a roller or a cylinder, comprising a supply roll having a cleaning cloth wound thereon and a take-up roll, an actuable pressure application disposed between said supply roll and said take-up roll, means for withdrawing the cleaning cloth from said supply roll by winding it on said take-up roll via said actuable pressure applicator so that said pressure applicator presses the cleaning cloth against a roller or cylinder to be cleaned, said pressure applicator having an elastic membrane member and a slidable spacer disposed adjacent one another, said membrane member having mutually opposite first and second end walls, said membrane member having mutually opposite marginal regions disposed thereon and extending from said first to said second end walls of said membrane member, clamping means for fastening said first and said second end walls of said membrane member sealingly to said spacer so as to define a compressed-air cushion between said membrane member and said spacer, said clamping means comprising a holding member for receiving said spacer therein in a manner like that of a sliding block, said holding member having a substantially C-shaped profile with mutually opposing legs, said legs having free ends respectively formed with guiding projections directed towards one another, said marginal regions of said membrane member engaging behind said guiding projections of said holding member, and means for biasing said spacer towards said guiding projections for sealingly clamping said marginal regions of said membrane therebetween.

2. Washing device according to claim 1, including tightening screws braced against said holding member for biasing said spacer towards said guiding projections of said holding member.

3. Washing device according to claim 2, wherein said guiding projections extend in a given direction, and said spacer is biased by a tightening force of said tightening screws in a direction perpendicular to said given direction in which said guiding projections extend.

4. Washing device according to claim 1, including a compressed-air supply connection projecting freely through said guiding member and firmly connected to said spacer.

5. Washing device according to claim 1, including means for screwing said spacer and said end walls of said membrane member together.

6. Washing device according to claim 1 wherein said membrane member is formed of rubber-elastic material.

* * * * *